US010144544B2

(12) United States Patent
Grace et al.

(10) Patent No.: US 10,144,544 B2
(45) Date of Patent: Dec. 4, 2018

(54) ADAPTER TO ALLOW THE EVACUATION OF A VACUUM BAG USING A HAIRDRYER OR OTHER AIR-MOVING DEVICE

(71) Applicants: Thomas A. Grace, Jackson, MI (US); Gregory T. Morano, Jackson, MI (US); William F. Steusloff, Jackson, MI (US); R. Dale Moretz, Jackson, MI (US); Vincent B Re, Brighton, MI (US)

(72) Inventors: Thomas A. Grace, Jackson, MI (US); Gregory T. Morano, Jackson, MI (US); William F. Steusloff, Jackson, MI (US); R. Dale Moretz, Jackson, MI (US); Vincent B Re, Brighton, MI (US)

( * ) Notice: Subject to any disclaimer, the term of this patent is extended or adjusted under 35 U.S.C. 154(b) by 0 days.

(21) Appl. No.: 15/442,885

(22) Filed: Feb. 27, 2017

(65) Prior Publication Data

US 2017/0247165 A1 Aug. 31, 2017

Related U.S. Application Data

(60) Provisional application No. 62/432,552, filed on Dec. 9, 2016, provisional application No. 62/300,829, filed on Feb. 27, 2016.

(51) Int. Cl.

| | |
|---|---|
| ***B65B 31/04*** | (2006.01) |
| ***B65D 81/20*** | (2006.01) |
| *B65D 85/18* | (2006.01) |

(52) U.S. Cl.

CPC ..... *B65B 31/047* (2013.01); *B65D 81/2038* (2013.01); *B65D 85/18* (2013.01)

(58) Field of Classification Search

CPC ..... B65B 31/047

See application file for complete search history.

(56) References Cited

U.S. PATENT DOCUMENTS

| | | | | | |
|---|---|---|---|---|---|
| 1,997,720 | A | | 4/1935 | Emmons | |
| 2,049,872 | A | | 8/1936 | Sera | |
| 2,368,624 | A | | 2/1945 | Walton | |
| 2,565,571 | A | | 8/1951 | Naumann | |
| 2,916,059 | A | * | 12/1959 | Wong | B65B 31/047 141/392 |
| 3,853,345 | A | * | 12/1974 | Miller | B63C 7/22 294/186 |
| 4,196,882 | A | * | 4/1980 | Rognon | F16B 47/00 248/205.9 |
| 4,553,284 | A | | 11/1985 | Strumbos | |
| 4,673,034 | A | | 6/1987 | Hansen | |
| 5,018,748 | A | | 5/1991 | Schalle | |
| 5,338,166 | A | | 8/1994 | Schultz | |

(Continued)

FOREIGN PATENT DOCUMENTS

DE 10302488 1/2005

*Primary Examiner* — Timothy L Maust
*Assistant Examiner* — Timothy P Kelly
(74) *Attorney, Agent, or Firm* — Vincent Re PLLC

(57) ABSTRACT

A vacuum adapter device is useful for connecting a suction generating device to a garment bag. The device includes at least one conical section. The conical section includes a wide opening configured be connected to one of the suction generating device and the garment bag and a narrow opening connected to a reinforcing feature configured to prevent the narrow opening from collapsing when suction is applied to the device. The conical section is constructed with a flexible polymer material.

8 Claims, 9 Drawing Sheets

(56) References Cited

U.S. PATENT DOCUMENTS

| | | | | |
|---|---|---|---|---|
| 5,511,752 | A * | 4/1996 | Trethewey | B25B 11/007 248/205.8 |
| 5,873,217 | A | 2/1999 | Smith | |
| 5,908,379 | A | 6/1999 | Schaefer et al. | |
| 5,938,083 | A | 8/1999 | Quinn | |
| 6,223,792 | B1 | 5/2001 | Slagle | |
| 6,375,143 | B1 | 4/2002 | Burns | |
| 7,140,402 | B2 | 11/2006 | Russell | |
| 8,096,329 | B2 | 1/2012 | Thout et al. | |
| 8,186,642 | B2 | 5/2012 | Weiss-Vons | |
| 8,746,491 | B2 | 6/2014 | Armstrong | |
| 2011/0230706 | A1 | 9/2011 | Warren | |

* cited by examiner

ADAPTER TO ALLOW THE EVACUATION OF A VACUUM BAG USING A HAIRDRYER OR OTHER AIR-MOVING DEVICE

CROSS REFERENCE TO RELATED APPLICATIONS

This disclosure claims the benefit of U.S. Provisional Application No. 62/300,829 filed on Feb. 27, 2016 and of U.S. Provisional Application No. 62/432,552 filed on Dec. 9, 2016, both of which are hereby incorporated by reference.

TECHNICAL FIELD

This disclosure is related to a polymerized adapter for channeling an airflow, in particular a compact and portable device for the evacuation of air from vacuum bags or other containers, including ancillary devices that may be used with commonly available devices and equipment to adapt those devices for such evacuation.

BACKGROUND

The statements in this section merely provide background information related to the present disclosure. Accordingly, such statements are not intended to constitute an admission of prior art.

Vacuum bags for compacting clothing and other articles for storage or transport are commonly available in various sizes and configurations. One of the most common methods to evacuate the air from these bags, compacting the contents, is the use of an ordinary and widely available vacuum cleaner, attaching the hose thereof to the valve of the vacuum bag. This works well in cases in which the user is at home, or otherwise has access to a vacuum cleaner. However, when traveling, users seldom have access to a vacuum cleaner, and generally are obliged to evacuate as much air as possible by rolling the vacuum bag tightly to evacuate as much air as possible, but, in the process, causing the bag and its contents to become distorted and wrinkled, reducing the effective volume by less than would be optimal.

SUMMARY

A vacuum adapter device is useful for connecting a suction generating device to a garment bag. The device includes at least one conical section. the conical section includes a wide opening configured be connected to one of the suction generating device and the garment bag and a narrow opening connected to a reinforcing feature configured to prevent the narrow opening from collapsing when suction is applied to the device. The conical section is constructed with a flexible polymer material.

BRIEF DESCRIPTION OF THE DRAWINGS

One or more embodiments will now be described, by way of example, with reference to the accompanying drawings, in which.

DETAILED DESCRIPTION

Figure 1:
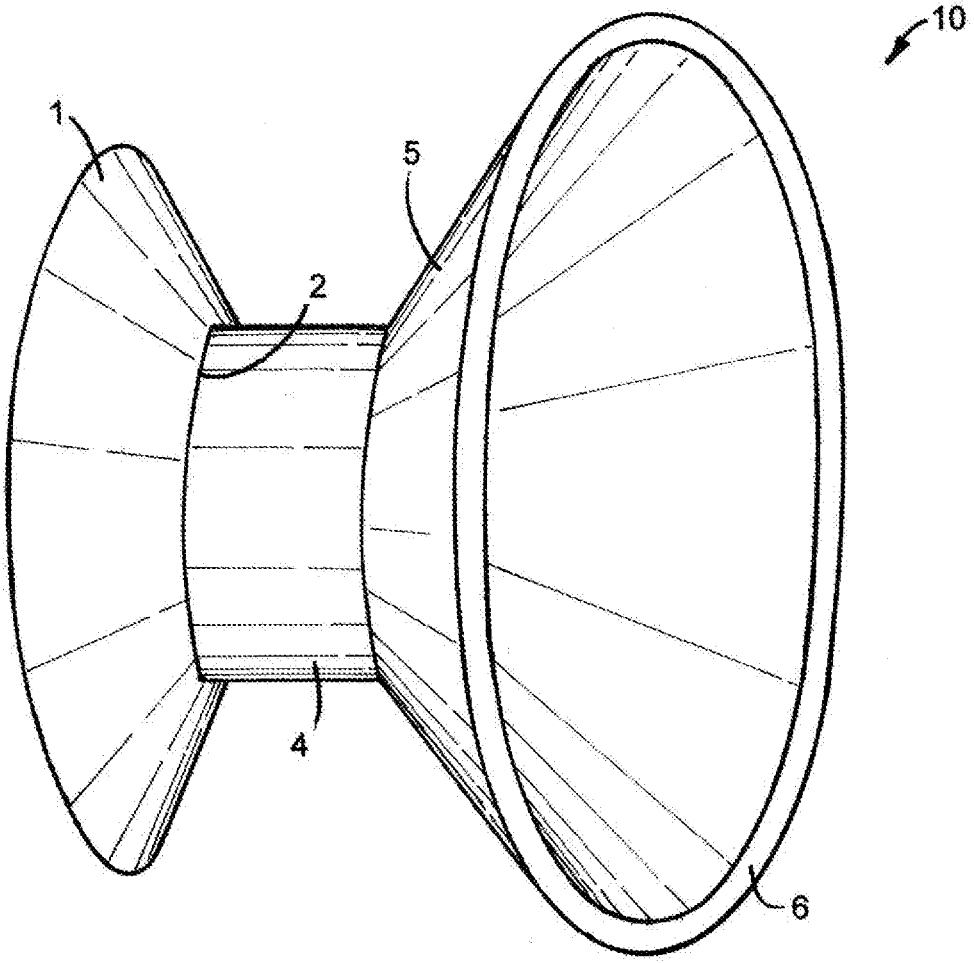
FIG. 1 is a perspective view of an exemplary vacuum adapter device in a perspective view, including a first conical section configured to attach to a hairdryer, a second conical section configured to attach to a garment bag valve portion, and a reinforced cylindrical section joining the two, in accordance with the present disclosure.

The present invention encompasses improvements to the prior art, by providing a simple and elegant design lending itself to very economical manufacturing means, providing a broadly adaptable interface with vacuum bags, enabling it to the used with most all of the available vacuum bags, and providing for easy collapse and compaction for transport.

With the present invention, any number of available hair dryers may be used to evacuate almost any of the vacuum bags currently available for purchase by consumers. It comprises a compact, flexible unit that is easily collapsed for inclusion in a traveler's luggage with a minimum of space requirement, and may be used to evacuate any number of air-containing vessels, including air mattresses.

Most hotels include a hair dryer in the hotel room for use by guests. While these hairdryers are intended primarily to blow air, heated to various levels, in order to dry the hair of guests after washing, they must draw air into the unit for that purpose. The intake is generally on the end of the hairdryer, and is defined on a surface that is round, oval or rectangular. The present invention is capable of functioning with all of these surfaces, being sufficiently flexible to conform to the various shapes, while being sufficiently stiff to maintain the opening connecting the hair dryer (or other device) to the vacuum bag valve. Moreover, in the preferred embodiment, the Adapter is capable of sealing interface with a variety of vacuum bags and vacuum bag valve designs, wherein a smaller cone defined on the opposite end of the Adapter from the conical section that conforms to the hair dryer of other device is sufficiently flexible, owing to a thinner section thickness, to readily conform, in response to the vacuum, to the surface of the vacuum bag surrounding the vacuum bag valve, whenever the shape and size of the vacuum bag valve is such that the end of the cylindrical section does not adequately seal on the internal or external diameter of the vacuum bag valve opening.

As required, detailed embodiments of the present invention are disclosed herein. However, it is to be understood that the disclosed embodiments are merely exemplary of the invention, which may be embodied in various and alternative forms. The accompanying drawings are not necessarily to scale, and some features may be exaggerated or minimized to show details of particular components or features. Therefore, specific structural or functional details disclosed herein are not to be interpreted as limiting, but merely as a representative basis for teaching one skilled in the art to variously employ the present invention.

Referring now to the drawings, wherein the numerals refer to like of corresponding parts throughout the several views, the present invention is generally characterized as an adapter, comprising a single, unitary molded item, in which a larger conical section is connected to a smaller section by a cylindrical section, completing an adapter whose larger conical section is designed to conform to the intake end of most hair dryers, and drawn into sealing contact with such hair dryer by the vacuum created by the air-moving portion of the hair dryer. The end of the cylindrical section at its intersection with the smaller conical section is of such size and shape to allow it to fit snugly with the termination of the valve of most vacuum storage bags. The smaller conical section is of such size and wall thickness as to allow it to be drawn sealingly to the surface of a vacuum storage bag surrounding the valve by the vacuum, effecting a functional seal even in those cases wherein the cylindrical termination does not adequately seal to the termination of the valve.

Adapter devices are disclosed for use connecting a hair drier device or other suction creating device to a garment bag. The suction created by the attached device pulls air through the adapter from the garment bag. The adapter device includes at least one conical section with flexible walls in the conical section which accommodates sealing to one of the hair drier device and garment bag or the valve portion of the garment bag. The adapter device, in addition to the at least one flexible conical section includes at least one reinforced portion configured to provide structure to the at least one conical section and prevent the device from collapsing upon itself as the suction is applied to the garment bag through the adapter. The reinforced portion can include a cylinder shaped portion with a reinforcing feature preventing the cylinder shaped portion from deforming in response to suction being applied to the adaptor.

Figure 2:
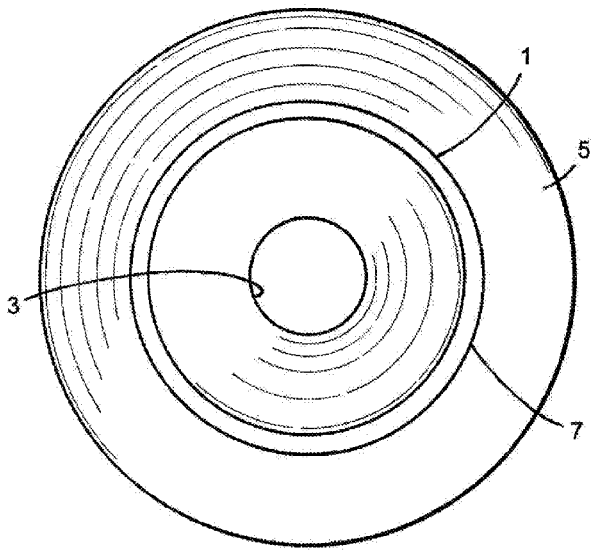
FIG. 2 is a perspective view of the adapter from above the larger conical section, in accordance with the present disclosure.
Figure 3:
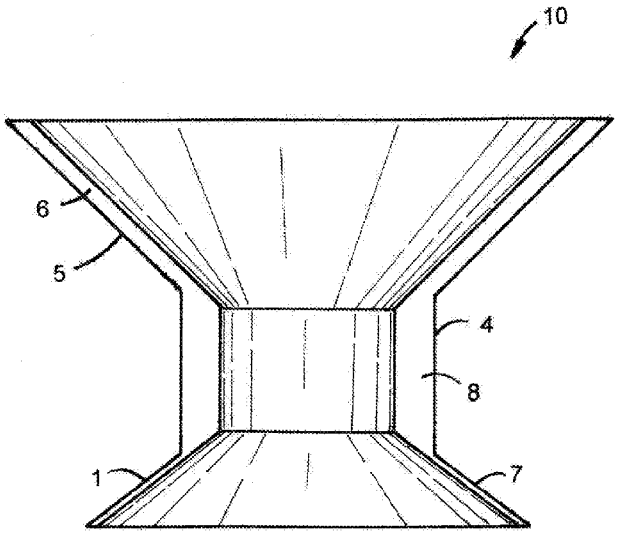
FIG. 3 is a cross-sectional view, wherein the larger conical section is shown at the top, the connection cylindrical section is shown in the center, and the smaller conical section is shown at bottom, in accordance with the present disclosure.

Referring now to the drawings, wherein the showings are for the purpose of illustrating certain exemplary embodiments only and not for the purpose of limiting the same, FIGS. 1-3 illustrate an exemplary vacuum adapter device in a perspective view, including a first conical section configured to attach to a hairdryer and a second conical section configured to attach to a garment bag valve portion. Adapter device 10 is illustrated. Small conical section 1 is illustrated connected to an intersection 2 with the cylindrical section, 4. The cylindrical section, 4, is shown connecting also connecting to larger conical section 5. According to one embodiment of the disclosure, section thickness of the material of cylindrical section 4 can be greater than the section thicknesses, 6 and 7, of either of the two conical sections, 5 and 1, respectively. In one embodiment, section thicknesses 6 and 7 can be kept relatively thin, such that the thin material of the two cone shapes can easily comply to a mating surface upon a connecting hairdryer and a mating surface around a valve portion of a garment bag. While it can be preferable for the cone sections to be pliable, it can also be preferable that cylindrical section 4 be resistant to deformation when a lower pressure or suction is applied within the device. This rigidity of cylindrical section 4 ensures that the suction applied by the hairdryer is useful to draw air from the garment bag. The increased thickness of cylindrical section 4 is one way to accomplish this rigidity. Other exemplary methods to increase the rigidity of cylindrical section 4 include forming annular ribs in the material of the cylindrical section 4, molding a plastic ring within cylindrical section 4, or molding a disk with through holes within cylindrical section 4. Each of conical sections 1 and 5 include wide openings configured to attach to one a suction generating device such as a hair drier and a valve portion of a garment bag. Each of conical sections 1 and 5 include narrow openings connected to a reinforced portion configured to prevent the narrow openings from collapsing when a suction is applied to the adapter device.

In FIG. 2, the adaptor 10 is shown viewing from the end with the smaller conical section, 1, with the numbers corresponding as in FIG. 1. Thickness 7 of smaller conical section 1 can be the same as thickness 6 of the larger conical section 5. In another embodiment, thickness 6 can be greater than the thickness 5. Internal diameter 3 of the cylindrical section 4 is illustrated in FIG. 2. Now referring to FIG. 3, adapter device 10 is illustrated, including a lateral section view showing in clearer detail the relative sizes of the two conical sections, 1 and 5, and the relative section thicknesses of the larger conical section, 6, the section thickness of the smaller conical section, 7, and the section thickness, 8, of the cylindrical section, 4.

The adapter may be constructed without the smaller conical section if it is desired to have it specialized and usable with vacuum bags with the same or very similar valve terminations, as might be the case if provided by the vacuum bag manufacturer or distributor with or as an option for that manufacturer's product.

Figure 4:
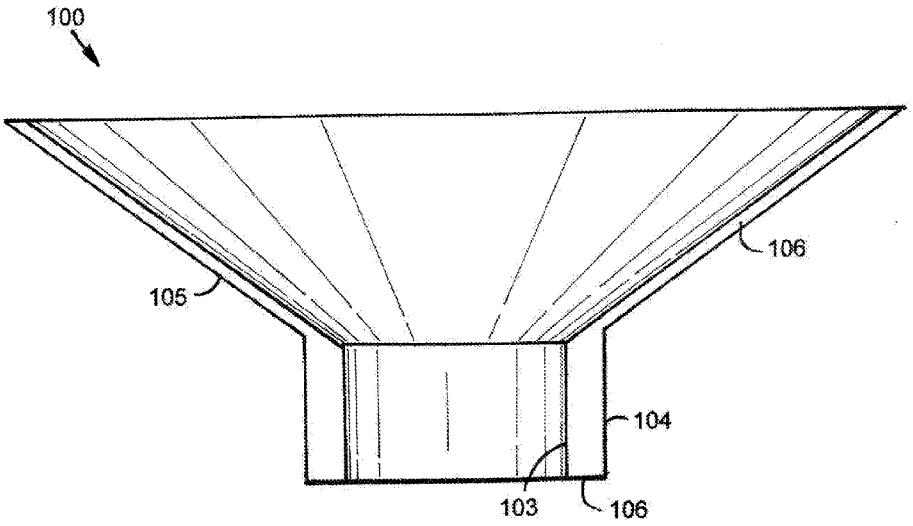
FIG. 4 illustrates an additional exemplary embodiment of a vacuum adaptor device in cross-sectional view, which includes a conical section and a reinforced cylindrical section, in accordance with the present disclosure.

FIG. 4 illustrates an additional exemplary embodiment of a vacuum adaptor device, which includes a conical section and a reinforced cylindrical section. Adapter device 100 is illustrated. Conical section 105 is illustrated connected to an intersection with the cylindrical section 104. The cylindrical section, 104, includes a thickness 106 which is wider than thickness 106 of conical section 105. The relatively wider thickness 106 of section 104 reinforces section 104. The relatively thinner thickness 106 of section 105 permits section 105 to deform and conform to a surface of one of a hair drier intake portion or a garment bag surface or valve.

Figure 5:
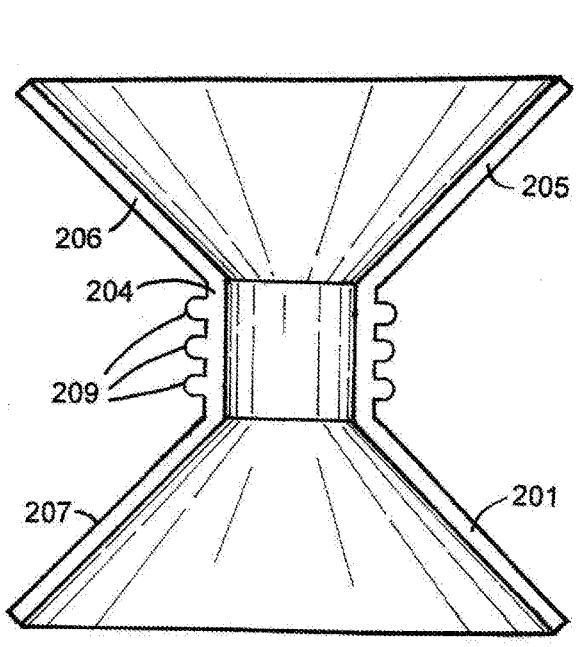
FIG. 5 illustrates an additional exemplary embodiment of a vacuum adaptor device in cross-sectional view, which includes a first conical section, a second conical section, and a cylindrical section joining the two conical sections, wherein the cylindrical section includes annular ribs around an outer circumference in order to reinforce the cylindrical section, in accordance with the present disclosure.

FIG. 5 illustrates an additional exemplary embodiment of a vacuum adaptor device, which includes a first conical section, a second conical section, and a cylindrical section joining the two conical sections, wherein the cylindrical section includes annular ribs around an outer circumference in order to reinforce the cylindrical section. Adapter device 200 is illustrated. First conical section 205 and second conical section 201 are each illustrated connected to an intersection with the cylindrical section 204. The cylindrical section, 204, includes a similar or same thickness of conical sections 205 and 201. Annular rings 209 formed on an outer surface of cylindrical section 204 reinforce section 204 and prevent section 204 from collapsing when suction is applied through adapter 200.

Figure 6:
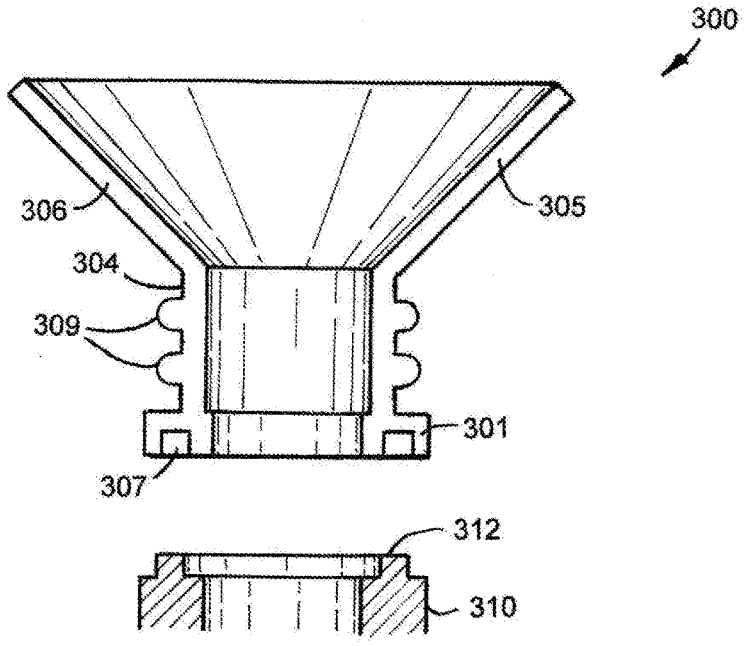
FIG. 6 illustrates an additional exemplary embodiment of a vacuum adaptor device in cross-sectional view, which includes a conical section and a cylindrical section, wherein the cylindrical section includes annular ribs around an outer circumference in order to reinforce the cylindrical section and a garment bag interface feature, in accordance with the present disclosure.

FIG. 6 illustrates an additional exemplary embodiment of a vacuum adaptor device, which includes a conical section and a cylindrical section, wherein the cylindrical section includes annular ribs around an outer circumference in order to reinforce the cylindrical section and a garment bag interface feature. Adapter device 300 is illustrated. Conical section 305 is illustrated connected to an intersection with the cylindrical section 304. The cylindrical section, 304, includes a similar or same thickness of conical section 305. Annular rings 309 formed on an outer surface of cylindrical section 304 reinforce section 304 and prevent section 304 from collapsing when suction is applied through adapter 300. Cylindrical section 304 includes interface features 301 configured to connect and seal to features 312 of garment bag valve 310.

Figure 7:
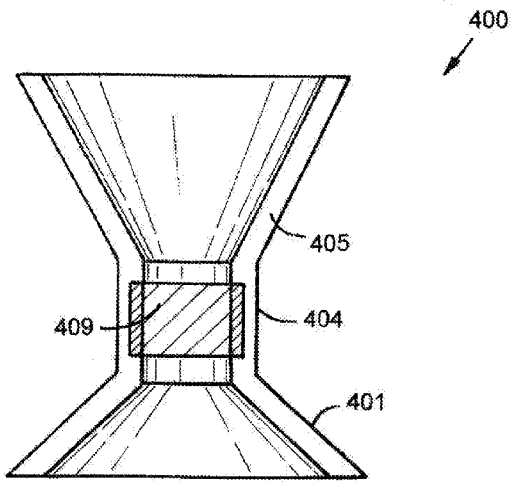
FIG. 7 illustrates an additional exemplary embodiment of a vacuum adaptor device in cross-sectional view, which includes a first conical section, a second conical section, and a cylindrical section joining the two conical sections, wherein the cylindrical section includes an molded-in ring to reinforce the cylindrical section, in accordance with the present disclosure.

FIG. 7 illustrates an additional exemplary embodiment of a vacuum adaptor device, which includes a first conical section, a second conical section, and a cylindrical section joining the two conical sections, wherein the cylindrical section includes a molded-in ring to reinforce the cylindrical section. Adapter device 400 is illustrated. First conical section 405 and second conical section 401 are each illustrated connected to an intersection with the cylindrical section 404. First conical section 405 includes a relatively narrower conical shape than the conical shape of second conical section 401. The cylindrical section, 404, includes a similar or same thickness of conical sections 405 and 401. A polymer ring 409 is molded-in within the material of section 404. The rigidity of polymer ring 409 prevents the cylindrical section from collapsing when suction is applied to adapter 400. Ring 409 can be exposed to an inner or outer surface of adapter 400, or ring 409 can be entirely within the material of adapter 400 such that the ring is not visible from an outside of the adapter.

Figure 8:
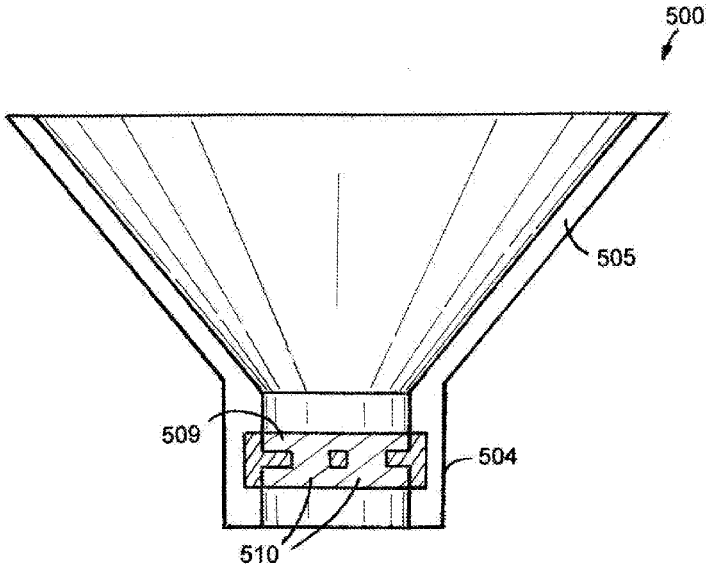
FIG. 8 illustrates an additional exemplary embodiment of a vacuum adaptor device in cross-sectional view, which includes a conical section and a cylindrical section, wherein the cylindrical section includes a molded-in disk including through holes in order to reinforce the cylindrical section, in accordance with the present disclosure.

FIG. 8 illustrates an additional exemplary embodiment of a vacuum adaptor device, which includes a conical section and a cylindrical section, wherein the cylindrical section includes a molded-in disk including through holes in order to reinforce the cylindrical section. Adapter device 500 is illustrated. Conical section 505 is illustrated connected to an intersection with the cylindrical section 504. A polymer disk 509 with through holes 510 is molded-in within the material of section 504 and reinforces section 504.

Figure 9:
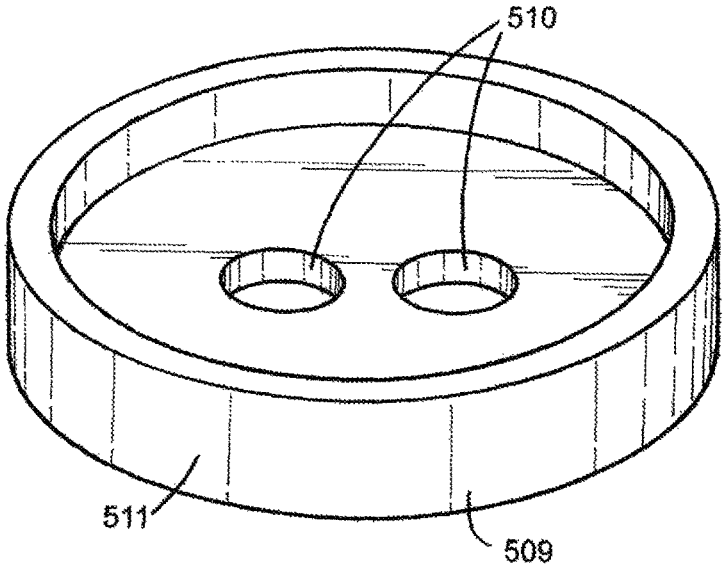
FIG. 9 illustrates the disk including through holes from FIG. 8, in accordance with the present disclosure.

FIG. 9 illustrates the disk including through holes from FIG. 8. Disk 509 is illustrated including two exemplary through holes 510 and outer surface 511. Surface 511 or any other surface of disk 509 or of ring 409 of FIG. 7 can include grooves or texturing to improve retention of the reinforcing feature to the mating material of a vacuum adapter device.

Figure 10:
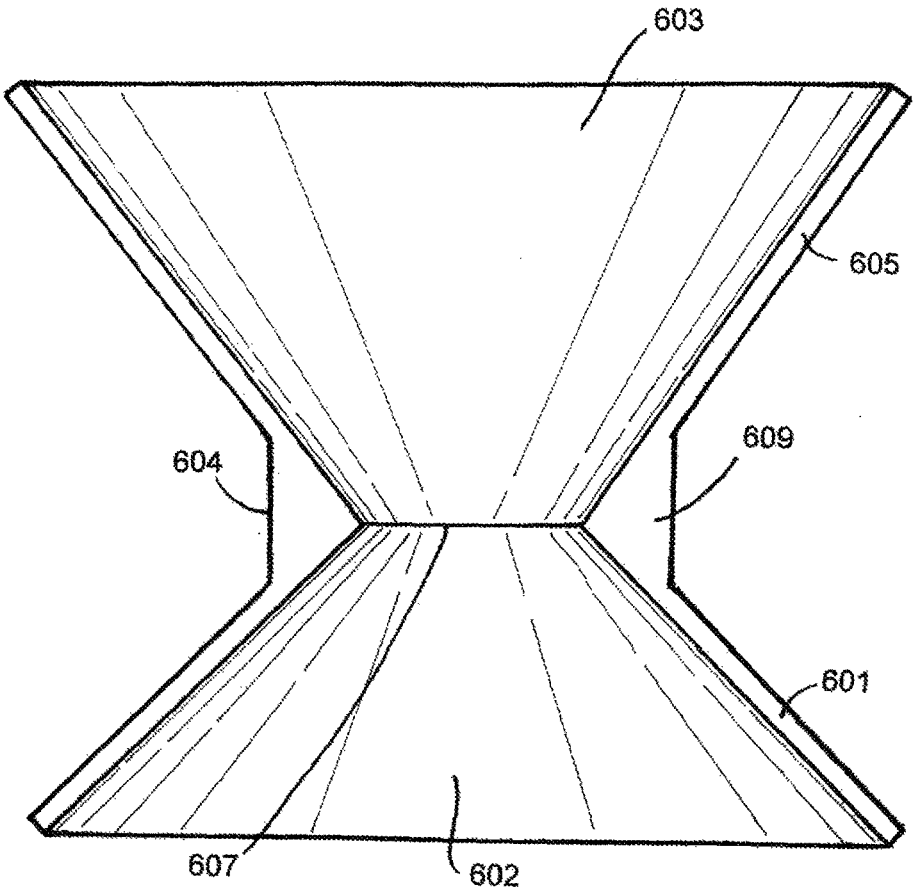
FIG. 10 illustrates an additional exemplary embodiment of a vacuum adaptor device in cross-sectional view, which includes a first conical section, a second conical section, and a cylindrical section joining the two conical sections, wherein interior surfaces of the cone shapes intersect within the two conical sections resulting in a triangular cross section within the cylindrical section, in accordance with the present disclosure.

FIG. 10 illustrates an additional exemplary embodiment of a vacuum adaptor device, which includes a first conical section, a second conical section, and a cylindrical section joining the two conical sections, wherein interior surfaces of the cone shapes intersect within the two conical sections resulting in a triangular cross section within the cylindrical section. Adapter device 600 is illustrated. First conical section 605 and second conical section 601 are each illustrated including interior conical shapes 603 and 602, respectively. A cylindrical section 604 is illustrated on an outside surface of device 600. Interior conical shapes 603 and 602 intersect within section 604 to form a triangular cross-section 609 within cylindrical section 604. The triangular cross-section 609 provides increased rigidity as compared to flat walls of the conical sections and prevents the cylindrical section from collapsing when suction is applied to adapter 600.

Figure 11:
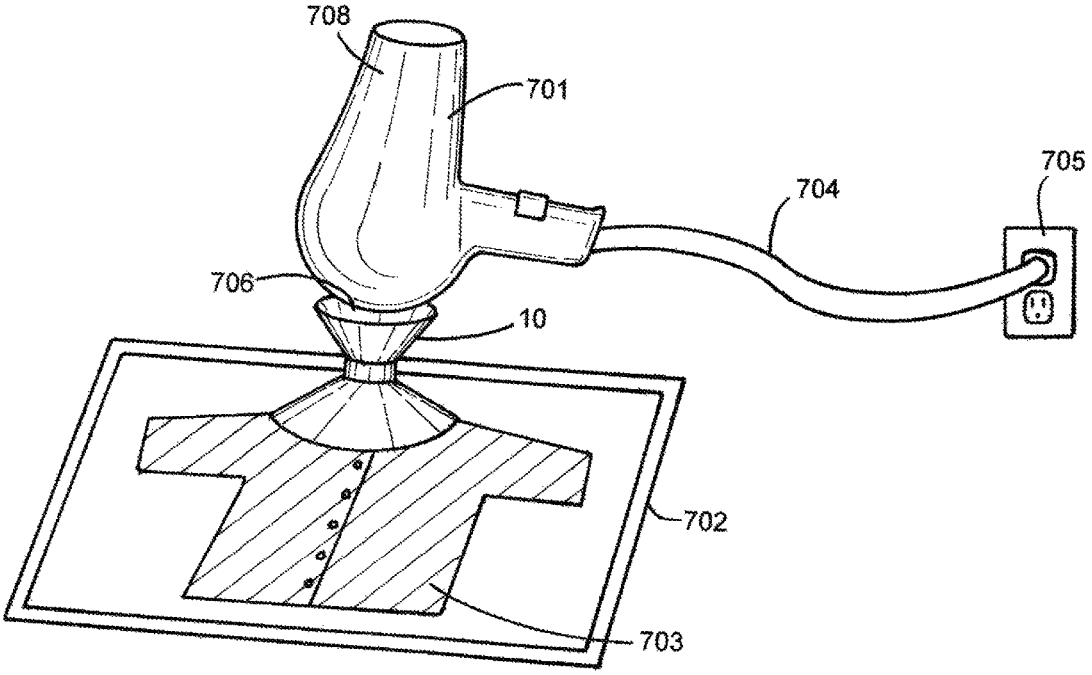
FIG. 11 illustrates the vacuum adapter device of FIG. 1 being used in conjunction with an exemplary hair drier device to remove air from an exemplary garment bag, in accordance with the present disclosure.

FIG. 11 illustrates the vacuum adapter device of FIG. 1 being used in conjunction with an exemplary hair drier device to remove air from an exemplary garment bag. Garment bag 702 is illustrated including an exemplary shirt 703 contained there within. Garment bag 702 includes a valve through which air can be removed from the bag, such that shirt 703 can be efficiently stored. Hair drier 701 is illustrated including air output portion 708 through which hot air is blown. Hair drier 701 additionally includes air intake portion 706 through which air is drawn into the drier. Power cord 704 provides power to hair drier 701 from AC outlet 705. Vacuum adapter device 10 is illustrated connecting a valve portion of garment bag 702 to the air intake portion 706, such that hair drier 701 can create a suction useful to draw air from the interior of garment bag 702 through adapter 10. Adapter 10 is illustrated with conical sections of the adapter deformed and conforming to the mating surfaces of hair drier 701 and garment bag 702, respectively. Any of the other adapter embodiments disclosed herein can be utilized similarly.

Figure 12:
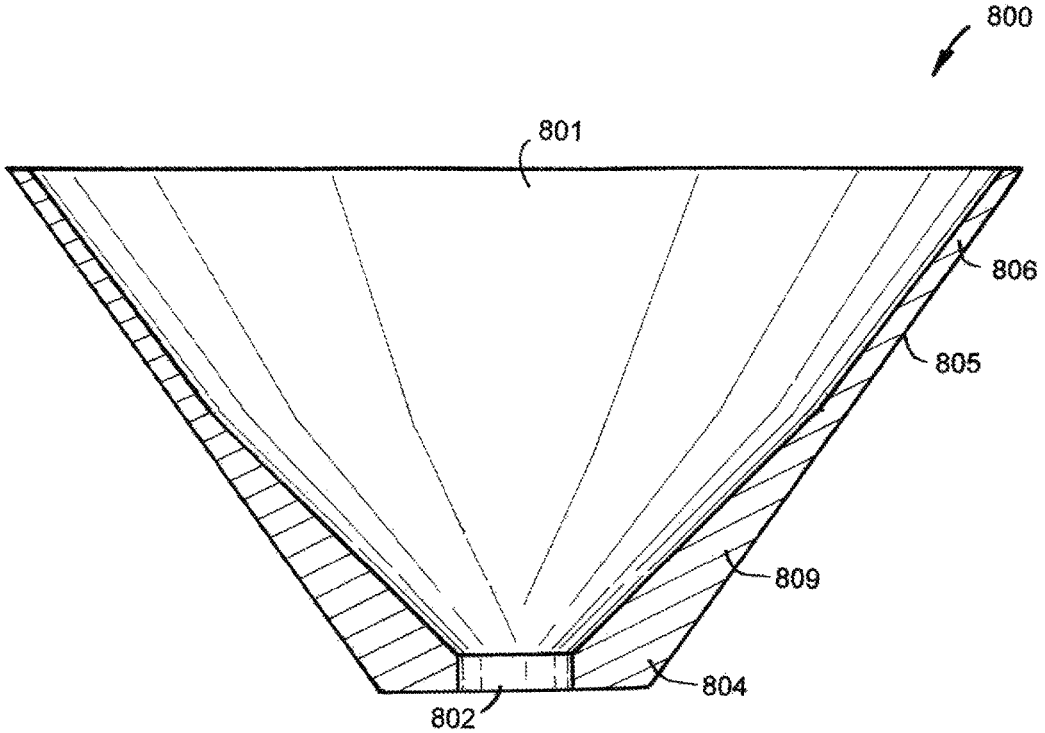
FIG. 12 illustrates an additional exemplary embodiment of a vacuum adaptor device in cross-sectional view, which includes a conical body, wherein a narrower opening of the conical section includes a thickened reinforced portion, in accordance with the present disclosure.

FIG. 12 illustrates an additional exemplary embodiment of a vacuum adaptor device in cross-sectional view, which includes a conical body, wherein a narrower opening of the conical section includes a thickened reinforced portion, in accordance with the present disclosure. Adapter 800 is illustrated. Conical body 805 is illustrated including a wider opening 801 including relatively thin wall thickness 806 and a narrower opening 802 including wider wall thicknesses 809 creating a reinforced portion 804. Reinforced portion 804 is relatively rigid as compared to thin walls near opening 801, resulting in portion 804 resisting collapse when suction is applied to adapter 800.

The disclosure has described certain preferred embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A system for connecting a suction generating device to a garment bag, comprising:

the garment bag comprising a suction valve;

a hairdryer including a front output nozzle configured to blow out hot air and a rear intake opening configured to draw in air; and a vacuum adaptor device constructed with a pliable, flexible polymerized material comprising:

a cylindrically-shaped section; and at least one conical section comprising:

a narrow opening connected to the cylindrically-shaped section;

a wide opening configured be connected to one of the rear intake opening of the hairdryer and the garment bag; and straight walls interior to the conical section connecting the narrow opening and the wide opening;

wherein the pliable, flexible material facilitates the vacuum adaptor device sealingly attaching to one of the rear intake opening of the hairdryer and the garment bag.

2. The system of claim 1, wherein the cylindrically-shaped section comprises a thickened wall thickness as compared to a wall thickness of the conical section at the wide opening.

3. The system of claim 1, wherein the cylindrically-shaped section comprises annular rings formed in an outer surface of the cylindrical section.

4. The system of claim 1, wherein the cylindrically-shaped section comprises a molded-in plastic ring.

5. The system of claim 1, wherein the cylindrically-shaped section comprises a molded-in disk comprising through holes configured to permit air to pass through the device.

6. The system of claim 1, wherein the conical section comprises a first conical section; and wherein the vacuum adaptor device further comprises a second conical section distal from the first conical section.

7. The system of claim 6, wherein the cylindrically-shaped section comprises a wall thickness thicker than a wall thickness of the first conical section and thicker than a wall thickness of the second conical section.

8. A system for connecting a suction generating device to a garment bag, comprising:

the garment bag comprising a suction valve;

a hairdryer including a front output nozzle configured to blow out hot air and a rear intake opening configured to draw in air; and a vacuum adaptor device constructed with a pliable, flexible polymerized material comprising:

a cylindrically-shaped section;

a first conical section comprising:

a narrow opening connected to the cylindrically-shaped section;

a wide opening configured be connected to one of the rear intake opening of the hairdryer and the garment bag; and straight walls interior to the conical section connecting the narrow opening and the wide opening; and a second conical section distal from the first conical section;

wherein the pliable, flexible material facilitates the vacuum adaptor device sealingly attaching to the rear intake opening of the hairdryer and the garment bag.

* * * * *